US008782836B2

(12) United States Patent
Fort

(10) Patent No.: US 8,782,836 B2
(45) Date of Patent: Jul. 22, 2014

(54) RESTRAINT APPARATUS

(71) Applicant: Dana A. Fort, Hinsdale, IL (US)

(72) Inventor: Dana A. Fort, Hinsdale, IL (US)

( * ) Notice: Subject to any disclaimer, the term of this patent is extended or adjusted under 35 U.S.C. 154(b) by 0 days.

(21) Appl. No.: 14/034,033

(22) Filed: Sep. 23, 2013

(65) Prior Publication Data

US 2014/0082848 A1 Mar. 27, 2014

Related U.S. Application Data

(60) Provisional application No. 61/706,461, filed on Sep. 27, 2012.

(51) Int. Cl.

| | |
|---|---|
| ***A47D 5/00*** | (2006.01) |
| ***A47D 13/08*** | (2006.01) |
| ***A61F 5/37*** | (2006.01) |

(52) U.S. Cl.

USPC ..... 5/655; 5/424; 128/870; 128/876

(58) Field of Classification Search

USPC ..... 5/655, 652, 657, 417, 420, 424, 625, 5/627, 628, 632, 630, 603, 722, 723, 691, 5/947; 128/869, 870, 875, 876, 846, 845

See application file for complete search history.

(56) References Cited

U.S. PATENT DOCUMENTS

| | | | | | |
|---|---|---|---|---|---|
| 2,846,700 | A * | 8/1958 | De Puy | 5/424 |
| 3,659,297 | A * | 5/1972 | Schutz | 5/655 |
| 3,721,434 | A * | 3/1973 | Spies | 5/655 |
| 4,712,258 | A * | 12/1987 | Eves | 5/424 |
| 4,935,973 | A * | 6/1990 | Behrman | 5/2.1 |
| 5,483,714 | A * | 1/1996 | Casassa | 5/655 |
| D393,561 | S * | 4/1998 | Hayes | D6/596 |
| 6,755,198 | B2 * | 6/2004 | Parker | 128/870 |
| 8,122,544 | B1 * | 2/2012 | Sandefur | 5/655 |
| 2004/0084052 | A1 * | 5/2004 | Parker | 128/870 |

* cited by examiner

*Primary Examiner* — Robert G Santos
(74) *Attorney, Agent, or Firm* — Seyfarth Shaw LLP

(57) ABSTRACT

A restraint device is disclosed for immobilizing an object, such as a child during diapering. The restraint device includes a strap extending through a base at a midsection thereof to prevent the object from rolling in a lateral direction. The device can also include a harness located within a pad of the base to firmly hold the strap in place. The harness can have a stiffness greater than the pad to provide the rigidity necessary to hold the strap in place, while having a hardness less than the support to provide comfort to the object restrained on the device. A cover can surround the base and can include sleeves to enclose a strap and protect the base from outside material such as excrement from a child.

11 Claims, 4 Drawing Sheets

RESTRAINT APPARATUS

RELATED APPLICATION

This application claims priority to provisional Patent Application No. 61/706,461, filed Sep. 27, 2012, the contents of which are herein incorporated by reference in their entirety.

TECHNICAL FIELD OF THE INVENTION

The present application relates to restraint devices. Particularly, the present application relates to child restraint devices to be used during diapering.

BACKGROUND OF THE INVENTION

Human and animal restraining systems are known in the art. For example, a papoose is a popular device for restraining a child during transport or while medical personnel are acting upon the restrained child. The papoose includes a solid board and straps connected to the solid board that hold the child in place.

Child restraining systems are also known in the art of diaper changing. Changing a child's diaper can often times be a difficult task. As children grow and learn to move about, they become less likely to remain still while on their backs during a diaper change. They will often roll over, sit up, attempt to arch their backs, or reach for objects next to the diapering station. These actions make it nearly impossible to effectively change the child's diaper or, at the very least, frustrate the parent or guardian changing the diaper.

Safety is a major concern with typical diapering stations. The Center for Disease Control and Prevention recently reported that half of the estimated 328,500 infants 12 months of age or younger who were treated for injuries in hospital emergency departments were injured as a result of a fall. Such falls occurred on staircases, flat ground, and diapering stations, raising major questions about the safety of an infant's home. The CDC's report confirms the need for safer diapering stations.

Diapering also requires multiple hands. One hand is needed to hold the child in a secure position, and one hand is needed to remove the diaper, clean the child, and replace the diaper. Because diapering with one hand is difficult, the child is often times not secured and is trusted to remain in position during the diaper changing process. Also, most diapering pads are placed on changing tables or beds, and the child is not safely secured on the changing surface. The child is therefore prone to fall from elevated changing surfaces.

Some diaper changing tables have a midsection buckle restraint due to the inherent dangers of diaper changing. This restraint is connected to the diaper changing pad and connects around the midsection of the child to keep the child immobilized during the diaper change. However, the conventional restraint fails to keep the child effectively immobilized because the straps are attached at the bottom of the pad and wrap around the side edges when immobilizing the child. The straps, when buckled together, form a gap between the side of the pad and the child, allowing the child to roll or otherwise escape the grasp of the straps and frustrate the diapering process. Other diaper changing pads include straps that do not extend through the pad completely and therefore lack the rigidity needed to hold the child in place.

SUMMARY OF THE INVENTION

The present application discloses a restraint device for immobilizing an object, such as a child during diapering. The restraint device includes a strap extending through a base at a midsection thereof and being adapted to couple to itself and form a loop in which the object is restrained. By positioning the strap in the midsection of the base, an object such as a child can be prevented from rolling in the lateral direction. The device can also include a harness located within a pad of the base to firmly hold the strap in place. The harness can have a stiffness greater than the pad to provide the additional rigidity necessary to firmly hold the strap in place, while having a hardness less than the support to provide comfort to the object restrained on the device. A cover can surround the base and can include sleeves to enclose the strap and protect the base from outside material such as excrement from a child.

In particular, the present application discloses a restraint device including a support having first and second support slots extending therethrough, the support further having a first support side and a second support side opposite the first support side, a pad positioned adjacent the first support side and having a middle pad section between a plurality of side pad sections, a pad opening being defined within the middle pad section, a harness disposed within the pad opening and having a first harness slot and a second harness slot separated from the first harness slot, a strap extending through the first harness slot and the first support slot and exiting at the second support side, the strap further entering the second support slot from the second support side and continuing through the second harness slot, and first and second connecting members coupled to the strap and adapted to couple the strap to itself to form a loop for restraining objects.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1:
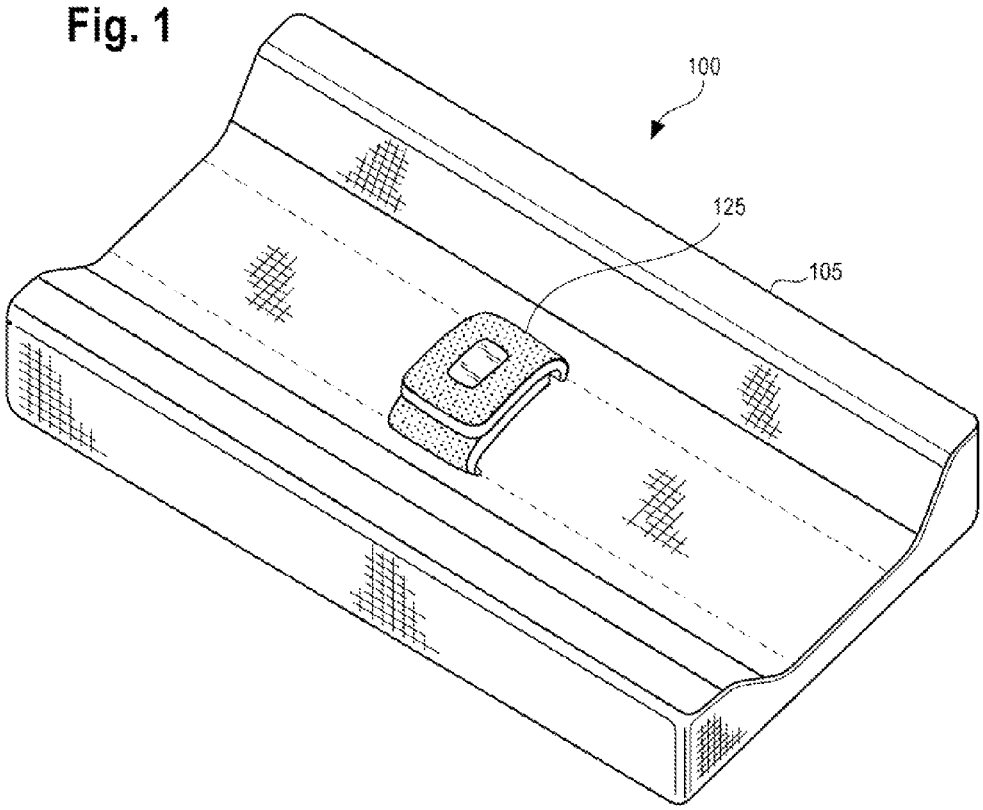
FIG. 1 is an isometric view of the restraint device in accordance with an embodiment of the present application.

It should be understood that the comments included in the notes as well as the materials, dimensions and tolerances discussed therein are simply proposals such that one skilled in the art would be able to modify the proposals within the scope of the present application.

DETAILED DESCRIPTION OF THE EMBODIMENTS

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated.

The present application discloses a restraint device for use in, for example, diapering. The restraint device includes a strap extending through a base at a midsection thereof and out of the back of the base. The strap is capable of coupling to itself to form a loop in which the object is restrained. By positioning the strap in the midsection of the base, an object such as a child can be prevented from rolling in the lateral direction.

The device can also include a harness located within a pad of the base to firmly hold the strap in place. The harness can have a stiffness greater than the pad to hold the strap in place, while having a stiffness less than the support to provide comfort to the object restrained on the table. A cover can surround the base and can include sleeves to enclose the strap and protect the base from outside material such as excrement from a child.

Figure 2:
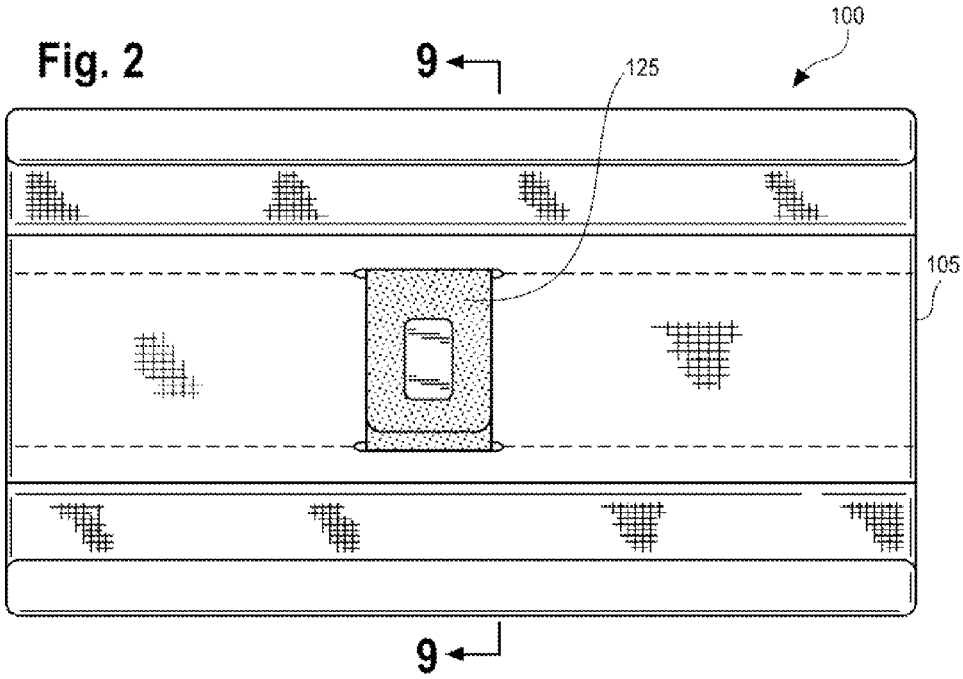
FIG. 2 is a top view thereof.
Figure 3:
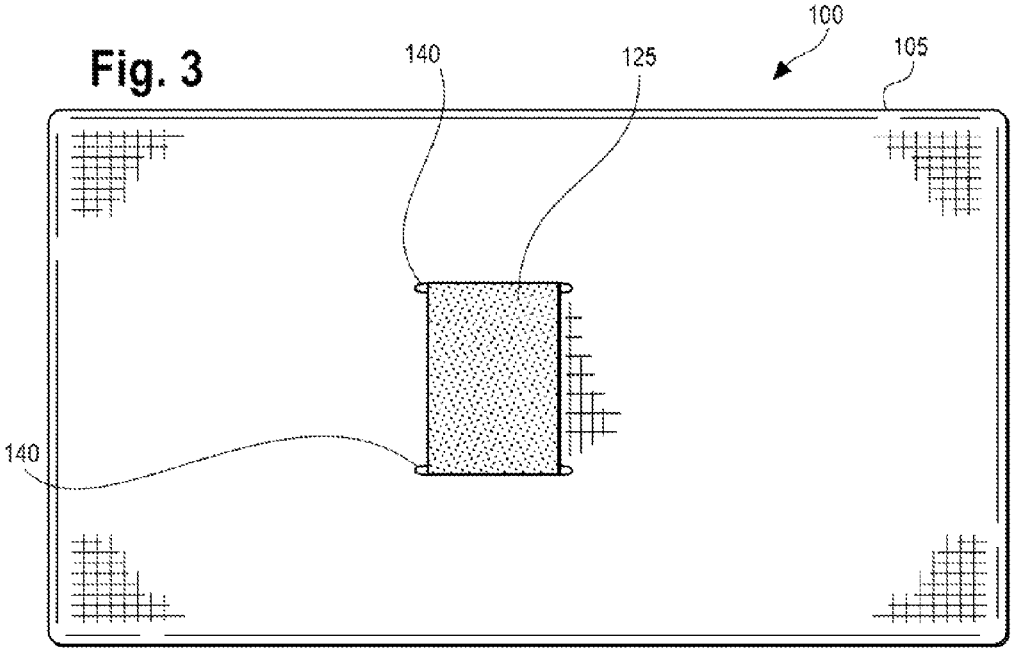
FIG. 3 is a bottom view thereof.
Figure 4:
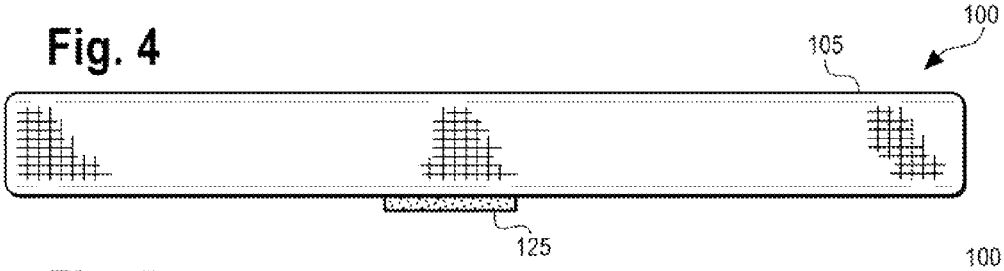
FIG. 4 is a right-side view thereof.
Figure 5:
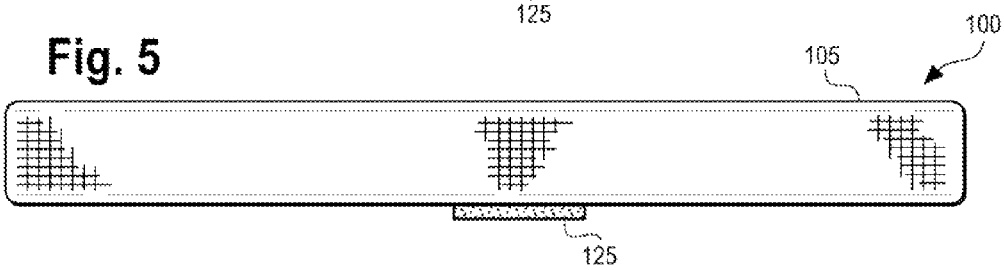
FIG. 5 is a left-side view thereof.
Figure 6:
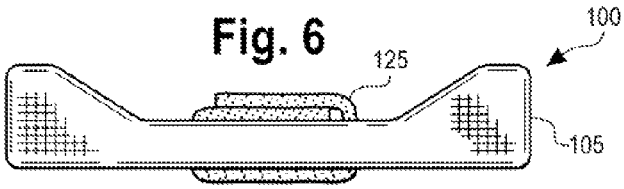
FIG. 6 is a front view thereof.
Figure 7:
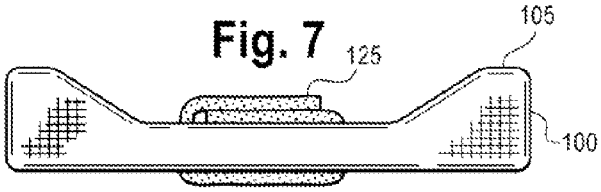
FIG. 7 is a rear view thereof.
Figure 8:
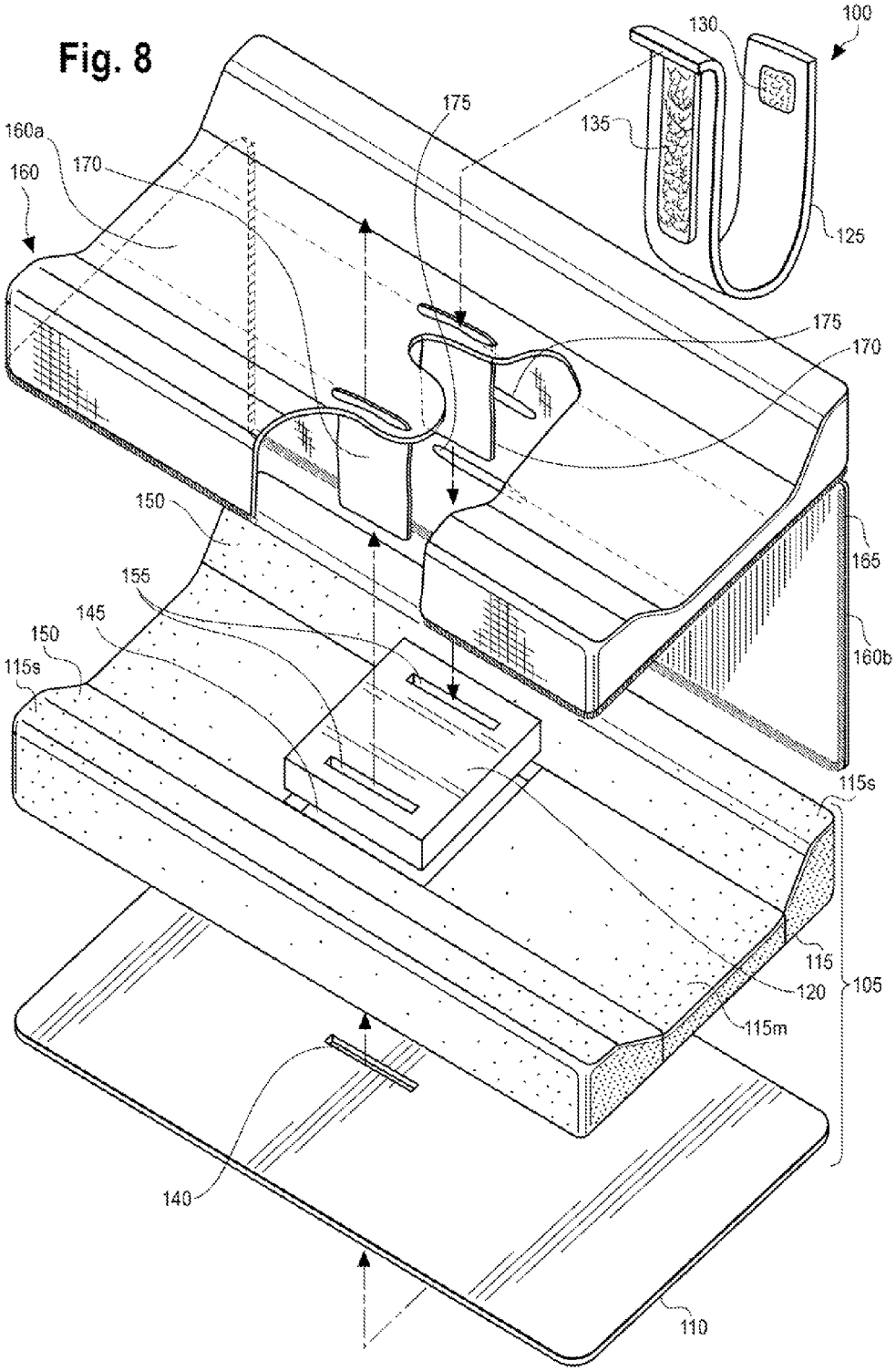
FIG. 8 is an exploded isometric view of an embodiment of the restraint device.
Figure 9:
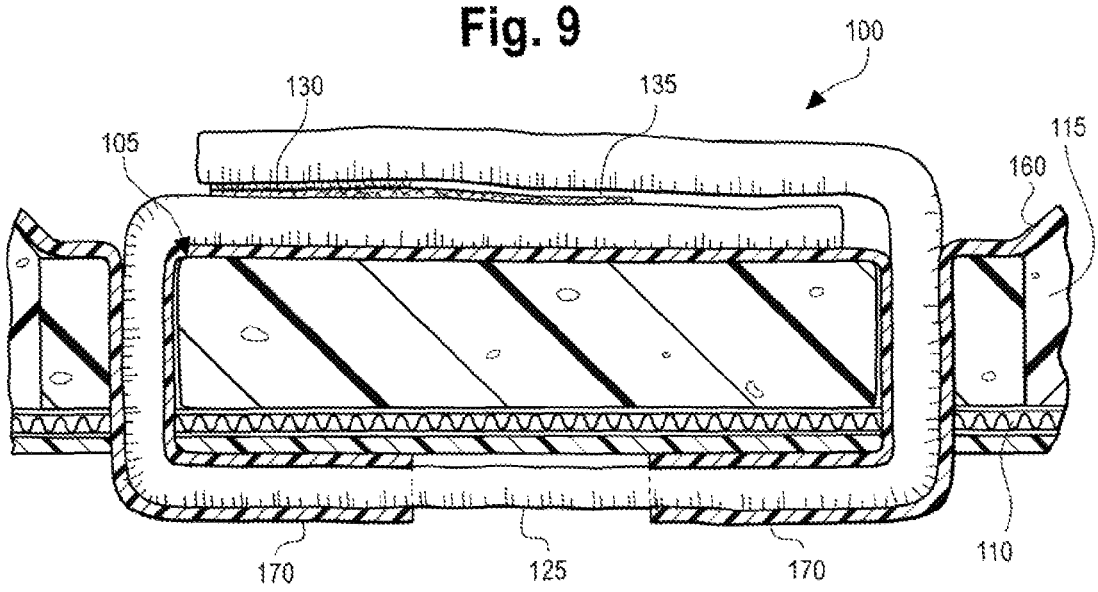
FIG. 9 is a sectional view of the device according to line 9-9 shown in FIG. 1.

FIGS. 1-9 illustrate a restraint device 100 according to the present application. As shown, the restraint device 100 includes a base 105 that includes a support 110, pad 115, and harness 120. A strap 125 can extend through the base 105 and retain the object on the base 105 by coupling to itself with connecting members 130. The support 110 is substantially rigid and acts as the structural backbone of the device. The pad 115 is soft and cushions the object positioned within the device, for example, a child during diapering. The harness 120 can have a stiffness between that of the support 110 and the pad 115 to provide the requisite level of structural stability while still being soft enough that comfort of the child is not sacrificed.

The support 110 acts as the structural backbone of the restraint device 100 and is the part of the device closest the ground or table upon which the object is being restrained. The support 110 can be made of any material, for example, wood, metal, Plexiglas®, carbon fiber, a hard composite material, or any other structural material with relatively high stiffness as compared to the pad 115 and the harness 120. The support 110 can include support slots 140 to receive the strap 125 when the strap is inserted entirely through the base 105 and to the back of the restraint device 100. As defined herein, the support 110 can include a first support side 110*a* and a second support side 110*b* opposite the first support side 110*a*.

The pad 115 can be any structure that supports an object being restrained, for example, a baby during diapering. The pad 115 is generally soft to provide additional comfort and can therefore be made of foam, or can be a housing that encloses a soft material such as cotton, feathers, or beans. Any other composition of the pad 115 can be implemented without departing from the spirit and scope of the present application.

The pad 115 can include a pad opening 145 to receive the harness 120 and support the strap 125. In addition, the pad 115 can include ledges 150 that act as a contoured outer surface to better maintain the object within the device 100. For example, if the object should roll during restraint, the ledges 150 can further prevent the object from rolling off the device 100 by providing a barrier for doing so. The pad 115 can therefore have three sections as defined by this application: a middle section 115*m* and two side sections 115*s*, the latter of which include the ledges 150.

The harness 120 can be a rectangular-shaped device with two harness slots 155 separated from one another to receive the strap 125. Alternatively, the harness 120 can include anchors that couple to the strap 125, or to multiple straps 125. The harness 120 is typically softer than the support 110 and harder than the pad 115. In this manner, the harness 120 can provide the structural stability to hold the strap 125 in place while also providing the requisite softness for the child or object positioned on the pad 115. The harness 120 can be made of any material, for example, foam, cotton, or a bean bag. Any other material can be implemented without departing from the spirit and scope of the present application.

The harness 120 is shown positioned in the middle section 115*m* of the pad 115. This positioning is advantageous for many reasons. For example, the strap 125 can be inserted through harness slots 155 and therefore prevent rolling much better than the prior art straps that wrap around the entire lateral side of the pad. Prior art straps extend around the entire device and therefore leave open gaps along the lateral sides of the object. The location of the strap 125 in the present application prevents such gaps by wrapping around the object being restrained, immediately entering the harness slots 155 and support slots 140, exiting from the back of the device 100, and returning through the opposite slots 140, 155 in the opposite direction, as shown. Such a configuration prevents gaps and therefore prevents rolling, and because the strap 125 exits extends through the entire base 105 and exits from the back of the base 105, the strap 125 is more structurally retained within the device 100.

The strap 125 can be any device or combination of devices capable of restraining an object. As shown, a single strap 125 is used. However, multiple straps 125 can be used without departing from the spirit and scope of the present application. As shown, the strap 125 can be inserted into harness slots 155 and support slots 140, and such slots 140, 155 can be aligned with each other or can be staggered.

As discussed above, the strap 125 includes connecting members 130, 135 that connect together to couple the strap 125 to itself. The connecting members 130, 135 can couple together in any manner, such as by using a buckle mechanism, Velcro®, magnets, adhesive, or any other means of coupling. In an embodiment, the strap 125 is a soft cotton-based material or canvas and couples together using Velcro®.

A cover 160 can enclose the device 100 and protect the device 100 from external contaminants, such as human excrement during diapering. The cover 160 can be made of any material and be any size or shape. In an embodiment, the cover 160 is coupled to itself by a zipper 165, but any connecting means can be implemented without departing from the spirit and scope of the present application.

The cover 160 can also include sleeves 170 that extend through cover openings 175 to protect the strap 125 from external contaminants. For example, the sleeves 170 can begin from a top surface 160*a* of the cover 160, and exit through the cover openings 175 located at the bottom surface 160*b* of the cover 160. The top surface 160*a* can be adjacent the top surface of the pad 115 and harness 120 and the bottom surface 160*b* can be adjacent the support 110. In this manner, the sleeves can extend entirely though the restraint device 100 by entering the base through the harness slots 155, continuing through the support slots 140, and exiting through the cover openings 175. The sleeves 170 therefore protect the base 105 from contaminants if the strap 125 becomes soiled.

The above components may be affixed to each other using any method. For example, the pad 115 may be coupled to the harness 120 and/or the support 110 by adhesive, fasteners, magnets, Velcro®, or any other coupling method, or the above components can be integral with each other as a single molded object. Furthermore, any or all parts of the restraint device 100 may be washable/and or water resistant.

The device is discussed above as being rectangular. However, the device can be any shape, for example, oval, circular, or square, without departing from the spirit and scope of the present application.

The embodiments discussed above illustrate the device 100 as a child restraining device for use during diaper changing. However, the device 100 can be used for any purpose, for example, animal restraint, adult restraint, or inanimate object restraint.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the claims of the forthcoming nonprovisional application when viewed in their proper perspective based on the prior art.

What is claimed is:

1. A restraint device comprising:

a support having first and second support slots extending therethrough, the support further having a first support side and a second support side opposite the first support side;

a pad positioned adjacent the first support side and having a middle pad section between a plurality of side pad sections, a pad opening being defined within the middle pad section;

a harness disposed within the pad opening and having a first harness slot and a second harness slot separated from the first harness slot;

a strap extending through the first harness slot and the first support slot and exiting at the second support side, the strap further entering the second support slot from the second support side and continuing through the second harness slot; and first and second connecting members coupled to the strap and adapted to couple the strap to itself and form a loop for restraining objects.

2. The device according to claim 1, further comprising a cover adapted to enclose at least the support, the pad, and the harness.

3. The device according to claim 2, wherein the cover includes a first cover side and a second cover side opposite the first cover side, and sleeves extending from the first cover side through openings defined in the second cover side.

4. The device according to claim 3, wherein the sleeves extend through the first and second support slots and the first and second harness slots.

5. The device according to claim 4, wherein the strap extends through the sleeves.

6. The device of claim 2, further comprising a zipper adapted to enclose the cover around the support, the pad, and the harness.

7. The device of claim 1, wherein a stiffness of the support is higher than a stiffness of the harness, and a stiffness of the harness is higher than a stiffness of the pad.

8. The device of claim 1, wherein the pad further includes ledges disposed at the side sections.

9. The device of claim 1, wherein the first and second connecting members are adapted to connect to one another by at least one member selected from the group consisting of a buckle mechanism, hook and loop fasteners, magnets, and adhesive.

10. The device of claim 1, wherein the support slots and the harness slots are aligned with each other.

11. The device of claim 2, wherein the cover is water resistant.

* * * * *